United States Patent [19]

Kraus

[11] 4,156,412

[45] May 29, 1979

[54] APPARATUS FOR PREVENTING CONTROL OSCILLATIONS IN A COMBUSTION MIXTURE GENERATOR

[75] Inventor: Bernd Kraus, Gerlingen, Fed. Rep. of Germany

[73] Assignee: Robert Bosch GmbH, Stuttgart, Fed. Rep. of Germany

[21] Appl. No.: 804,833

[22] Filed: Jun. 8, 1977

[30] Foreign Application Priority Data

Jun. 11, 1976 [DE] Fed. Rep. of Germany ..... 2626227
Oct. 29, 1976 [DE] Fed. Rep. of Germany ..... 2649271

[51] Int. Cl.[2] ..... F02M 7/00

[52] U.S. Cl. ..... 123/119 EC; 123/32 EE; 60/276

[58] Field of Search ..... 123/119 EC, 32 EE, 32 EA, 123/32 EB, 32 EC; 60/276, 285

[56] References Cited

U.S. PATENT DOCUMENTS

| | | | |
|---|---|---|---|
| 3,782,347 | 1/1974 | Schmidt et al. | 123/32 EE |
| 3,831,564 | 8/1974 | Schmidt et al. | 60/285 |
| 3,990,411 | 11/1976 | Oberstadt et al. | 123/32 EA |
| 3,998,189 | 12/1976 | Aoki | 123/32 EE |
| 4,024,707 | 5/1977 | Schmidt et al. | 60/276 |
| 4,029,061 | 6/1977 | Asano | 123/32 EE |
| 4,077,364 | 3/1978 | Aoki | 60/285 |
| 4,089,313 | 5/1978 | Asano et al. | 123/119 EC |

*Primary Examiner*—Charles J. Myhre
*Assistant Examiner*—Andrew M. Dolinar
*Attorney, Agent, or Firm*—Edwin E. Greigg

[57] ABSTRACT

A circuit to be used in association with a fuel mixture control system which includes an oxygen sensor in the exhaust system to determine the relative richness of the combustible mixture. When the engine operates at low speeds, its control response time becomes large due to decreased engine throughput. In order to prevent control oscillations from occcurring under these conditions, the time constant of integration of the oxygen sensor control loop is changed to accommodate to the longer engine response time. For this purpose, the zero crossings of the oxygen sensor signal are compared with the unstable time constant of a multivibrator and a transistor which normally shunts a timing resistor is blocked, thereby increasing the time constant of the control integrator.

6 Claims, 2 Drawing Figures

APPARATUS FOR PREVENTING CONTROL OSCILLATIONS IN A COMBUSTION MIXTURE GENERATOR

BACKGROUND OF THE INVENTION

1. Field of the Invention

The apparatus relates to the field of fuel-air mixture preparation for internal combustion engines. More particularly, it relates to fuel mixture preparation in which a λ or oxygen sensor is used in the exhaust system of the engine to provide a signal related to the presence of oxygen in the exhaust gas and permitting deductions as to the relative richness or leanness of the fuel mixture supplied to the engine. Typically, the λ-sensor signal is fed to a comparator where a comparison is made between the magnitude of the λ-signal and a local, possibly adjustable, set-point voltage. The output of the comparator is then fed to an integrator which engages a final control element in the mixture preparation system to adjust the fuel-air ratio.

2. State-of-the-Art

The use of so-called λ-sensors or oxygen sensors in the exhaust system of an internal combustion engine for providing an actual control value to control the fuel-air mixture is known. When such a sensor is used, the overall system may be identified in the following manner. The carburetor or fuel injection system together with the engine is the overall control system. In that system, the engine itself is the controlled variable and the mixture preparation system is the controller which receives an output signal from the λ-sensor that acts as the actual, operational value for the loop. The nominal or desired fuel-air ratios are determined on the basis of the rpm and the air flow rate aspirated by the engine. For example, fuel injection systems are known which inject fuel intermittently or continuously to the combustion chambers or the induction tube of the engine. One of the problems encountered in such control processes has been the fact that the time constant of the λ control is adjusted for optimum exhaust gas conditions, i.e., the time constant of the controller is held relatively small so as to permit a rapid response to changing operational conditions. However, and especially if the controller is capable of substantial adjustments, the engine often see-saws at idling, i.e., there are periodic rpm changes due to the fact that the time constant of the engine itself is not constant but depends on the engine speed. This means that when the engine runs relatively slowly, for example at idling, the engine time constant is increased due to the slower passage of gases through the engine. This type of increase in the engine response time or engine dead time leads to pronounced control oscillations unless the time constant of the control process is adapted to the changed conditions which occur when the engine idles.

OBJECT AND SUMMARY OF THE INVENTION

It is thus a principal object of the present invention to provide an apparatus for association with the mixture preparation system of an internal combustion engine for preventing control oscillations in such a system, especially at low engine speeds. It is a further and more particular object of the invention to change the time constant of the λ-controller in certain operational domains of the engine.

It is yet another object of the invention to change the time constant of the controller at low engine speeds.

These and other objects are attained according to the invention by providing a circuit which uses the time period which elapses between the zero crossing times of the λ-sensor signal and which includes a timing circuit. Depending on whether the period of zero crossings or the time constant of the timing circuit is larger, the apparatus of the invention switches an additional resistor into the timing components of an integrating circuit, thereby increasing the time constant at lower engine speeds. The apparatus according to the invention provides the advantage that the time constant can be changed in the idling domain of the engine so that control oscillations are substantially or completely suppressed even if the time constant, i.e., the response constant of the engine, changes. It is a particular advantage of the present invention that no additional mechanical connections to the throttle plate switch or other electrical lines to electronic control elements are required. This is possible because the invention is based on the recognition that the zero crossing time of the λ-sensor may be used as a measure for the effective response time of the engine. Accordingly, the apparatus of the present invention may be built with relatively little effort and at relatively low expense but nevertheless reliably prevents the occurrence of control oscillations in operational states where such oscillations would normally occur. Another advantage of the invention is that it may be adapted to widely different types of engine control systems.

The invention may be used in any type of mixture preparation systems, for example carburetors of varying construction and fuel injection systems.

The invention will be better understood as well as further objects and advantages thereof become more apparent from the ensuing detailed description of an exemplary embodiment taken in conjunction with the drawing.

DESCRIPTION OF THE PREFERRED EMBODIMENT

Figure 1:
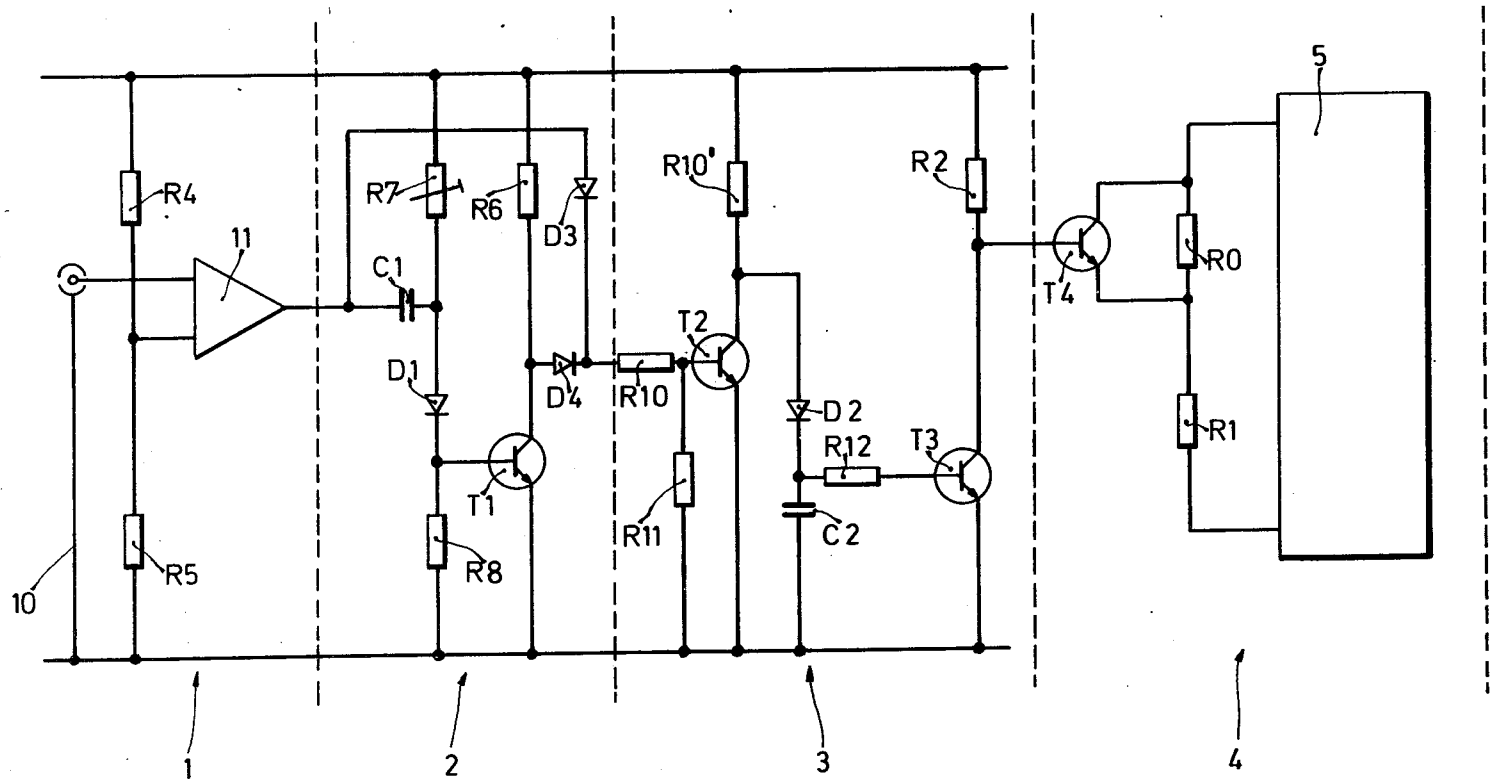
FIG. 1 is a circuit diagram of a preferred exemplary embodiment of a circuit according to the invention for changing the controller time constant of a λ control system.

The circuit of which FIG. 1 is a schematic diagram is a preferred exemplary embodiment of a device which permits changing the time constant of a λ controller when certain operational conditions are encountered. The change of the time constant is performed primarily for suppressing possible control oscillations.

As already discussed, the overall system which includes the internal combustion engine, the mixture preparation system and the λ-sensor can be regarded as a control system in which the engine plays the role of the controlled variable whereas the mixture preparation system is the controller and the λ-sensor produces an actual value which is a measure of the composition of the mixture fed to the engine, i.e., of its air factor λ.

A control system of this type has a plurality of inherent time constants, one of these being for example the time constant of the controlled variable which may be regarded as that time period which must pass before a change exerted by the final control element at the input can be recognized as a change of the actual value by the sensor disposed downstream, i.e., in this case the λ-sensor. This time period will be referred to below as the "dead time" of the engine and its value depends on the prevailing operational state of the engine. The reason for this dependence is that the dead time will be relatively large if the throughput of gas through the engine is relatively small, as is the case at idling. Thus, when the engine idles, any change of the mixture is recognized by the λ-sensor relatively late. For this reason, it is possible that the dead time of the engine may approach the order of magnitude of the normal control time constant and may in fact exceed it. In the case, the controller so to speak lags the engine and, especially when the control adjustments are large, periodic changes in the fuel supplied to the engine may occur. Such periodic changes result in periodic engine speed changes at idling. A cyclic alternation of the engine speed at idling is sometime referred to as engine "sawing".

Turning now to FIG. 1, there will be seen a circuit consisting of several sub-circuits. The first of these sub-circuits is a comparator circuit 1 followed by a circuit 2 which is a timing circuit, feeding a control circuit 3. The control circuit 3 engages an output circuit 4 which would normally be connected to the final control element in the loop, for example a member of the fuel mixture metering system. The sub-circuit 4 includes a provision for changing the inherent time constant of the output circuit 4. Inasmuch as the basic response time, i.e., dead time of the controlled variable, i.e., the engine, cannot be changed, being due to the normal gas throughput through the engine, the present invention addresses the problem of this operationally dependent dead time by changing the time constant of the control loop if the engine enters a domain where pronounced control oscillations might occur. The controller which, in this case, is the carburetor or the fuel injection system, need not be discussed in detail for it is not a primary subject of the present invention. However, normally the output circuit 4 includes an integrator in which the rate of integration is a parameter which actually determines the controller's time constant. In FIG. 1, the integrator bears the reference numeral 5 and is represented only as a block. In the present case, the time constant of the integrator is determined by the combination of series-connected resistors R0 and R1. When both resistors are connected in series and are effective, the time constant of the integrator will obviously be larger. This can be illustrated by supposing that the integrator will contain at least one timing element, for example a capacitor, which is charged and discharged through the series-connected resistors R0 and R1. It is clear that this charging and discharging process will take longer the larger are the values of the resistor chain through which the charging and discharging current must flow. Thus it may be stated at the outset that in normal operation, when control oscillations are not expected, the resistor R0 is removed from the effective current path by short circuiting it with the collector-emitter path of a transistor T4. Thus, in the normal operation of the engine, the transistor T4 conducts as will be appreciated by noting that its base is connected to a resistor R2, in turn connected to the positive supply rail of the circuit, which causes the transistor T4 to conduct provided that the transistor T3 in series with the resistor R2 and connected on the emitter side to ground is blocked. The decision on whether the resistor R0 is to be included in the series connection of the timing elements of the integrator 5 is made on the basis of information obtained from the output of the λ-sensor or its subsequent comparator. This decision is made by a timing circuit 2 which receives its input signal from a comparator 11 which compares the λ-sensor signal from a λ-sensor 10 with a set-point value provided, for example, from a voltage divider composed of resistors R4 and R5 connected between the positive and negative supply lines of this circuit. The comparator 11 may be an operational amplifier and its output signal would follow a curve such as that illustrated schematically in FIG. 2*a*. This curve derives from the fact that the λ-sensor responds to the presence or absence of oxygen in the exhaust gas and its output voltage jumps abruptly from a low value of approximately 100 mV when the input mixture is lean (excess oxygen in the exhaust gas) to a value of approximately 900 Mv for a rich input mixture. The output voltage of the comparator is fed to the main components of the circuit 2 which constitute a monostable multivibrator whose time constant is chosen to be equal to the maximum time constant of the control system still permitting operation without control oscillations. The monostable multivibrator of circuit 2 is a so-called economy mono flip-flop and includes a transistor T1, the emitter of which is grounded or connected to a negative potential and whose collector is connected through a resistor R6 to the positive supply line. A voltage divider chain, consisting in this case of an adjustable resistor R7, a diode D1 connected to pass positive currents and a resistor R8, is connected between the positive and negative supply lines. The base of the transistor T1 is connected to the junction of the cathode of the diode D1 and the resistor R8. The output of the comparator 11 is coupled to the junction of the resistor R7 and the anode of the diode D1 via a capacitor C1.

Figure 2:
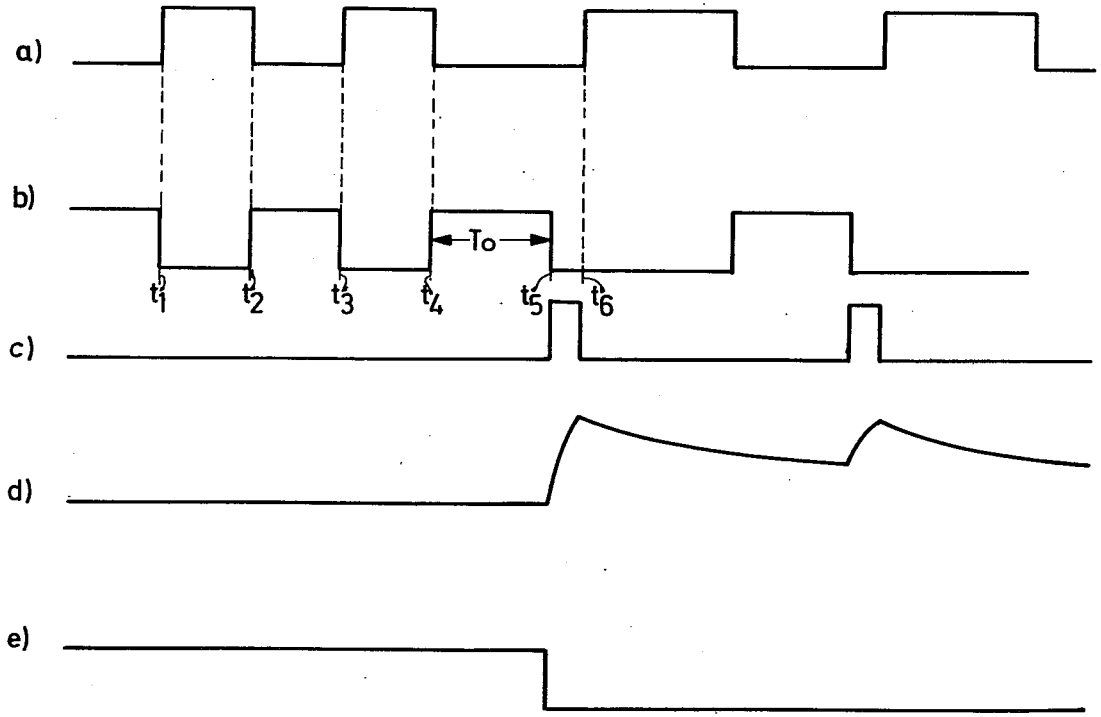
FIG. 2 is a set of curves illustrating the occurrence of various potentials as a function of time in the circuit according to FIG. 1.

Following the monostable multivibrator of circuit 2 is a control circuit including a transistor T2 connected in the usual manner which a collector resistor R10' and a base drain resistor R11. The circuit includes a further transistor T3 whose base is connected to the collector of the transistor T2 via a positive passing diode D2 and possibly a base resistor R12. A further capacitor C2 is connected between the junction of the resistor R12 and the anode of the diode D2 and ground. The circuit described so far operates as follows, as may be seen with the aid of FIGS. 2*a* through 2*e*. As already mentioned, the time constant of the monostable flip-flop 2 is adjusted to be equal to that engine response time or dead time which may be just tolerable and beyond which the circuit should be altered to accomodate a larger dead time so as to eliminate control oscillations. If the circuit 2 receives no triggering pulses, the transistor T1 is conducting due to the voltage received from the base voltage divider consisting of the elements R7, D1 and R8. This state corresponds to the stable state of the flip-flop. Negative-going edges of the comparator output voltage flip the circuit into its monostable or unstable state because the negative charge on the capacitor C1 blocks the diode D1 and thus also the transistor T1. Once the negative charge on the capacitor C1 has decayed through the adjustable resistor R7, the transistor T1 returns to its conducting state. The operation of the circuit of FIG. 1 will be better understood if it is remembered that, in normal operation, i.e., when the control loop time constant is sufficiently large with respect to the dead time of the engine, the transistor T4 is conducting. Thus, in such cases, the transistor T3 must be blocked, which in turn requires that the transistor T2 be conducting. The timing diagram 2*b* illustrates the time constant $T_0$ of the unstable state of the flip-flop. As long as that time $T_0$ is larger than the time which elapses between two successive zero crossings of the sensor voltage, i.e., the output of the comparator output voltage shown in FIG. 2*a*, the comparator output voltage will always trigger the flip-flop 2 in time so as to maintain it in its astable state and prevent its return to its stable state. This takes place as follows: During the positive half cycle of the comparator output voltage, i.e., from the time $t_1$ to the time $t_2$, the transistor T1 conducts anyway so that its collector output voltage shown in FIG. 2*b* is substantially at ground potential. During this time, the positive output voltage from the comparator holds the transistor T2 conducting via the diode D3 so that T3 is blocked and T4 conducts, thereby keeping only the resistor R1 as the effective timing resistor in the circuit 4. However, during the negative half cycle of the comparator output voltage, i.e., from the time $t_2$ to the time $t_3$, the transistor $t_1$ is placed into its blocking state while the flip-flop 2 is in its astable condition. Thus, the diode D3 blocks but the transistor T2 is kept conducting through the diode D4 which transmits a positive voltage from the collector of the transistor T1 to the base of the transistor T2.

If, however, the negative half cycle of the comparator output voltage, i.e., beginning at the time $t_4$ up to the time $t_6$, happens to be longer than the time constant $T_0$ of the flip-flop 2 (given by $T_0=C1 \cdot R7$) the flip-flop 2 returns to its normal stable state in which the transistor T1 conducts and the diode D4 is blocked. However, during the continuing negative voltage of the comparator, i.e., from the time $t_5$ to the time $t_6$, the transistor T2 cannot be held in conduction even through the diode D3 so that it blocks during this time period ($t_5$ to $t_6$) and its collector delivers a positive voltage jump according to the curve 2c. This leads to a rapid charging of the capacitor C2 via the diode D2 which conducts when the transistor T2 is blocked. For this reason, the transistor T3 also conducts and places the base of the subsequent transistor T4 at a sufficiently negative potential so that T4 blocks and introduces the resistor R0 in series with the resistor R1 in the timing chain of the circuit 4. The discharge time constant of the capacitor C2 is so chosen that the transistor T3 will always conduct if the collector of the transistor T2 exhibits continuing positive pulses, i.e., if the dead time of the engine continues to be larger than the preset time constant $T_0$ of the flip-flop. For this reason the effective total resistance $R=R_0+R_1$ is maintained until finally the flip-flop time constant $T_0$ is larger than the engine dead time so that the transistor T4 begins to conduct again. The voltage at the capacitor C2 is shown in curve 2*d* and the curve 2*e* shows the voltage at the collector of the transistor T3.

As already mentioned above, the apparatus according to the present invention may be used in association with any type of mixture preparation system, for example those using carburetors, fuel injection systems and the like. If carburetors are used, the fuel nozzle cross sections may be changed by the controller or some other fuel delivering mechanism can be engaged. The invention is especially useful in controlling the exhaust gas recycle rate in mixture preparation systems, for controlling the flow through bypass conduits or to provide additional adjustment of the duration of fuel injection control pulses in electronic fuel injection systems, for example by engaging the multiplying stage of such systems. In general, the use of λ-sensor control systems and the associated circuitry according to the present invention may be used in any systems or engines in which combustible fuel is delivered to the combustion regions of the engine or system by means of vacuum or under pressure.

The foregoing relates to merely preferred exemplary embodiments of the invention, it being understood that other embodiments and variants thereof are possible within the spirit and scope of the invention.

What is claimed and desired to be secured by Letters Patent of the United States is:

1. An apparatus for controlling the fuel-air mixture ratio for an internal combustion engine, said apparatus including an oxygen sensor for generating first and second signals and being disposed in the exhaust system of said engine, a comparator for generating an output signal having first and second states by comparing the signals from said oxygen sensor with a set-point signal, an integrating circuit having selectable rate-determining components to provide at least a slow and a fast rate of integration, said rates being co-determinative of the prevailing control time constants for receiving the output from said comparator and for providing an integrated signal to a final control element which adjusts the ratio of said fuel-air mixture; and wherein the improvement comprises:

timing circuit means including a monostable multivibrator for receiving the signals from said sensor to derive therefrom a datum related to the time between the occurrence of said first and second oxygen sensor signals as a measure of the engine control response time;

control circuit means connected to said timing circuit means for changing the connection of at least some of said rate-determining components in said integrating circuit to thereby decrease the rate of integration and increase the control time constant when said datum related to engine control response time indicates that the engine control response time is equal to or greater than the prevailing control time constant.

2. An apparatus as defined by claim 1, wherein said monostable multivibrator has an unstable time constant selected to be equal to an engine control response time at the occurrence of which the rate of integration in said integrating circuit is to be altered.

3. An apparatus as defined by claim 1, wherein said monostable multivibrator is triggered into an unstable state during the occurrence of said first state of the output signal from said comparator and said apparatus further includes a storage circuit which is charged by said monostable multivibrator when the duration of said unstable state is smaller than said first state of said comparator output signal.

4. An apparatus as defined by claim 1, wherein said rate determining components in said integrator circuit include a first timing resistor and a second timing resistor in series with said first timing resistor, a transistor connected in parallel with said second timing resistor, a storage circuit actuated by said timing circuit means for controlling said transistor; whereby when said storage circuit is charged, said transistor is blocked and thereby interrupts the shunt across said second timing resistor.

5. An apparatus as defined by claim 4, wherein said multivibrator is connected to the base of a second transistor (T2) said base of said second transistor (T2) being further connected to the output of said comparator and the emitter and collector of said second transistor (T2) being connected across a power supply voltage; whereby during normal engine operation at higher than idling speed, said second transistor (T2) is held in its conductive state by a positive output voltage from said comparator and by the signal from said monostable multivibrator in its unstable state.

6. An apparatus as defined by claim 5, wherein said storage circuit includes a capacitor connected in series with a diode across said second transistor (T2) and further comprising a third transistor (T3) the base of which is connected to the junction of said diode and said capacitor; whereby when said capacitor is discharged, said third transistor (T3) blocks and a transistor (T4) connected in parallel with said second timing resistor and controlled by said third transistor (T3) is rendered conducting and wherein the charging time constant of said storage circuit is substantially smaller than the discharging time constant thereof.

* * * * *